United States Patent [19]

Freeman, Sr.

[11] 4,081,087

[45] Mar. 28, 1978

[54] PIPE LAYDOWN AND PICKUP MACHINE

[76] Inventor: Richard B. Freeman, Sr., 1230 W. Main St., Houma, La. 70360

[21] Appl. No.: 651,159

[22] Filed: Jan. 21, 1976

[51] Int. Cl.[2] ..... E21B 19/14

[52] U.S. Cl. ..... 214/2.5; 104/112; 175/85

[58] Field of Search ..... 214/2.5, 1 P, DIG. 3, 214/13, 1 PB; 212/98, 81, 84, 88; 104/112, 114; 175/85

[56] References Cited

U.S. PATENT DOCUMENTS

| | | | |
|---|---|---|---|
| 532,837 | 1/1895 | Tefft | 212/98 X |
| 1,076,599 | 10/1913 | Miller | 104/114 |
| 2,194,125 | 3/1940 | Rinehart | 214/1 PB |
| 2,201,813 | 5/1940 | Doud | 214/2.5 |
| 3,361,080 | 1/1968 | Born | 104/114 |
| 3,532,229 | 10/1970 | Scaggs | 214/2.5 |
| 3,713,547 | 1/1973 | Beck | 214/2.5 |
| 3,774,780 | 11/1973 | Buffington | 214/2.5 |
| 3,825,129 | 7/1974 | Beck | 214/2.5 |

FOREIGN PATENT DOCUMENTS

| | | | |
|---|---|---|---|
| 970,355 | 7/1975 | Canada | 214/2.5 |

*Primary Examiner*—Drayton E. Hoffman
*Assistant Examiner*—George F. Abraham
*Attorney, Agent, or Firm*—Clarence A. O'Brien; Harvey B. Jacobson

[57] ABSTRACT

A machine for laying down or picking up pipe sections, casing sections and the like during a well drilling operation and includes a draw works associated with a catwalk alongside of a pipe rack and oriented in normal relationship to a drill rig with cable arrangements extending from the draw works to a sheave supporting post assembly anchored in the rathole pipe in the drill rig floor. Carriages are mounted on the cable assembly for picking up a pipe section or laying down a pipe section in relation to the catwalk and conveying the pipe section to and from a position adjacent the sheave supporting post assembly in the rathole pipe thereby enabling the pipe section to be picked up by the structure in the drill rig in order to assemble the pipe section with sections already in the drill rig and to facilitate removal of the pipe sections when breaking down or disassembling a pipe string.

8 Claims, 6 Drawing Figures

PIPE LAYDOWN AND PICKUP MACHINE

BACKGROUND OF THE INVENTION

1. Field of the Invention

The invention generally relates to an apparatus for picking up and laying down pipe sections, casing sections or the like employed during the drilling of a well or while other operations are being conducted in relation to a well such as an oil well or the like and more particularly to an apparatus for picking up a pipe section from a catwalk and conveying it to the drill rig or returning a pipe section to the catwalk from the drill rig and includes a draw works and cable assembly associated with the catwalk and a supporting post oriented in the rathole pipe in the drill rig floor.

2. Description of the Prior Art

The handling of elongated pipe or casing sections has long been a problem when making up or breaking down an elongated, multiple section string such as is used in oil well drilling and other procedures associated with oil wells and other wells. In view of the elongated nature of the pipe sections and the weight thereof, the pipe sections cannot be effectively handled without utilization of mechanical devices. Many devices have been developed for handling pipe including my prior U.S. Pat. Nos. 3,159,286, issued Dec. 1, 1964 and 3,169,645, issued Feb. 16, 1955 and other devices and apparatuses have been disclosed in prior U.S. Pat. Nos. 1,621,009, issued Mar. 13, 1927, 2,201,813, issued May 21, 1940; 2,425,292, issued Aug. 12, 1947; 2,539,751, issued Jan. 30, 1951; 2,690,046, issued Oct. 5, 1954; and 3,065,865, issued Dec. 27, 1962.

While the previously known devices have improved the handling techniques and apparatuses and have been used extensively, problems still exist in effectively and efficiently handling pipe sections in a manner which is not only efficient but also will insure the safety of personnel on the catwalk, drill rig floor and the like.

SUMMARY OF THE INVENTION

An object of the present invention is to provide a pipe laydown and pickup machine for moving or conveying a pipe section from the catwalk to the drill rig or from the drill rig to the catwalk and includes a draw works, cable assembly and carriages or dollies supported thereby for picking up a pipe section in a secure manner and moving it to a desired position with the cable assembly that is remote from the draw works being supported by a post oriented in the rathole in the drill rig floor.

Another object of the invention is to provide an arrangement in which the pipe supporting carriages or dollies are stabilized by engagement with vertically spaced cables to prevent the dollies from swinging laterally to facilitate their assembly with the pipe sections and to maintain the dollies and pipe sections in stable condition.

Another object of the invention is to provide a device in accordance with the preceding object in which a counterbalance weight is connected to one of the dollies for biasing it away from the draw works and to assure its proper positioning in relation to the pipe section being handled.

A further object of the invention is to provide a pipe laydown and pickup machine in which the support for the cable is vertically adjustable and readily removable from the rathole pipe in the drill rig floor.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figures 1, 4, 5:
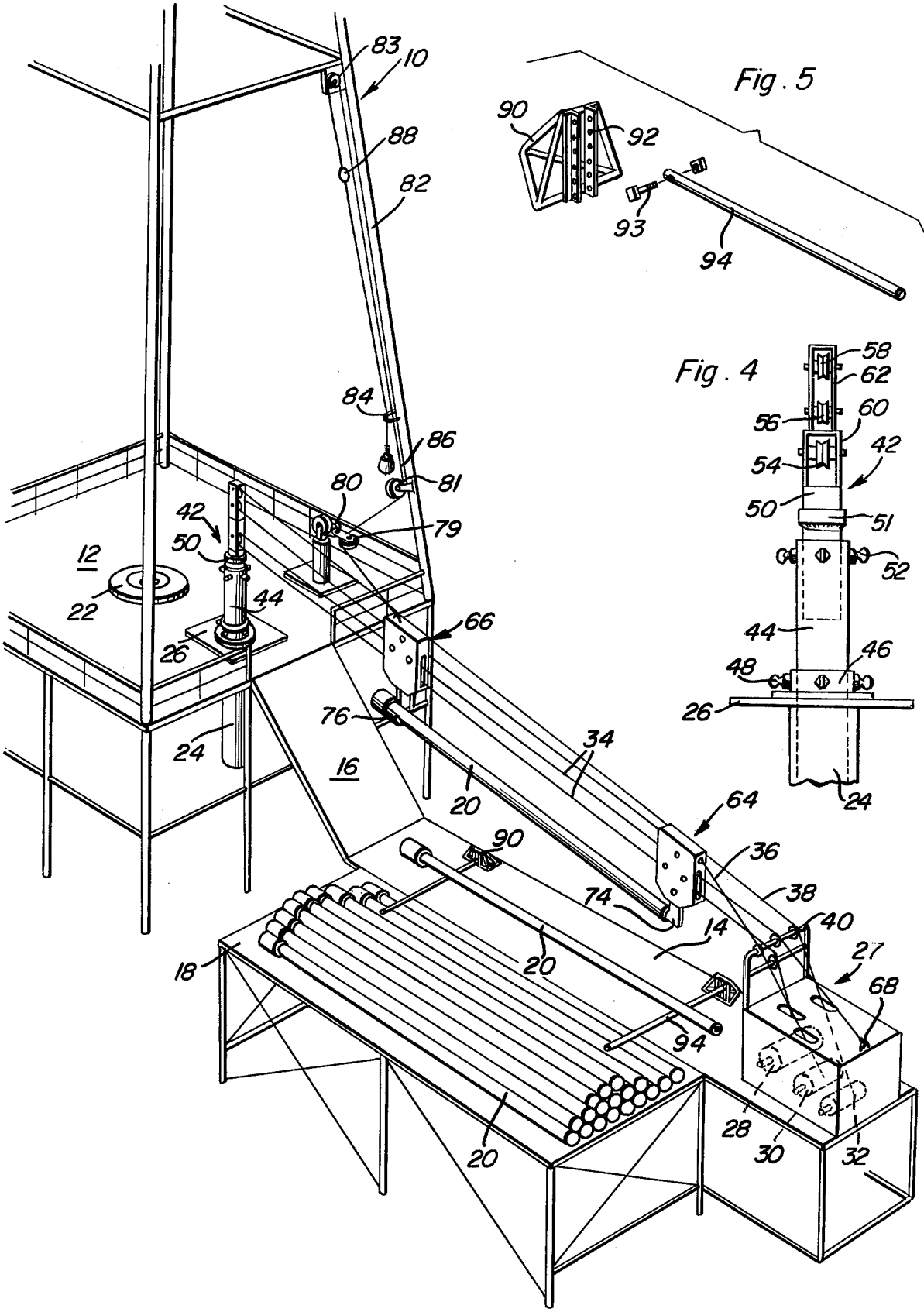
FIG. 1 is a fragmental perspective view illustrating the pipe laydown and pickup machine associated with the pipe rack, catwalk and drill rig structure.
FIG. 4 is a detailed elevational view of the supporting post structure received in the rathole in the drill rig floor.
FIG. 5 is a group perspective view illustrating a vertically adjustable structure attached to the catwalk to facilitate movement of the pipe sections to and from the pipe rack.

The pipe laydown and pickup machine of the present invention is associated with equipment normally located at a well site and which includes a drill rig or derric generally designated by the numeral 10 and which includes a rig floor 12 supported above the ground surface in any suitable manner and provided with the usual crown block, traveling blocks, elevators and other associated equipmenet not illustrated in detail inasmuch as the conventional componenets form no particular part of the present invention. Disposed to one side of the drill rig 10 is a catwalk 14 of conventional construction which basically involves a horizontal supporting surface and an inclined ramp or slide 16 extends from the catwalk 14 to the rig floor 12 in a conventional manner. A pipe rack 18 is oriented alongside of the catwalk and pipe sections 20 are stored on the pipe rack 18 in a conventional and well known manner. The rig floor 12 includes a conventional rotary table 22 and a rathole pipe 24 and rathole support structure 26 all of which represent conventional structures incorporated into the drill rig.

Mounted on the end of the catwalk remote from the rig is a draw works or winch assembly generally designated by the numeral 27 with the catwalk including an extension for supporting the draw works or the draw works may be supported on a separate vehicle alined with the end of the catwalk. The draw works includes winch drums 28, 30 and 32 having cables 34, 36 and 38 wound thereon and passing over guide pulleys or sheaves rotatably supported on an elevated frame 40.

The cables extend to and are supported by a support assembly 42 in the form of a tubular post or pipe 44 telescoped into the rathole pipe 24. The rathole pipe 24 is provided with a collar 46 on the upper end thereof above the support 26 with the collar 46 including a plurality of setscrews 48 which enables vertical adjustment of the pipe 44 in relation to the rathole pipe 24.

Telescoped into the pipe 44 is a short supporting pipe 50 secured in place by setscrews 52 in the upper end of the pipe 44 to enable removal of the supporting pipe 50 along with the pulleys or sheaves 54, 56 and 58 which are journaled between supporting members 60 and 62 as illustrated in FIG. 4. Thus, when it is desirable to remove the cable assembly, it is only necessary to remove the top tubular member or post 50 with the cables remaining in place thereon. A collar 51 is welded onto pipe 50 to limit the downward sliding movement thereof.

As illustrated in FIG. 1, the cable 38 is wound on winch drum 32 and extends longitudinally to the support assembly 42 and is entrained over the uppermost pulley or sheave 58 and straight down and under the pulley or sheave 56 and then returns back to a carriage or dolly generally designated by numeral 64. The cable 36 is connected to the opposite side of the dolly and extends to the winch drum 30. The cable 34 extends from the winch drum 28 through carriage or dolly 64 and through a carriage or dolly 66 and extends under and around pulley or sheave 54 and then extends back through the carriage or dolly 66 and the carriage or dolly 64 and is anchored to the draw works at 68. Each of the dollies 64 and 66 has a plurality of pulleys or sheaves journaled therein designated by numerals 70 and 72 respectively which engage both runs of the cable 34 which are spaced vertically apart thus providing stability to the carriages 64 and 66 so that the hooks 74 and 76 thereon will be stabilized for engaging a pipe section 20 with the hook 74 extending longitudinally into the end of the pipe section 20 and the lateral hook 76 extending under the pipe for supporting the end thereof to orient it in inclined relation as it is moved toward the drill rig floor so that the elevators may be utilized to pick up the pipe section for orienting it vertically in the drill rig in a well known manner. The hook 76 is half hexagonal in shape so that it will not slip off the pipe when picking up or lowering the pipe. A counterweight cable 78 is connected to the carriage or dolly 66 and extends over a pulley 79 attached to a kelly or swivel 80 inserted into the kelly hole normally to the right of the rathole pipe 24. The cable then extends to the rig leg, over a pulley 81 and then upwardly and is entrained over a top pulley 83 supported on the drill rig 10 with the cable 78 extending downwardly along the corner member or leg 82 of the derrick through a guide structure 84 and having a weight 86 on the free end thereof. A stop member 88 is provided on the cable 78 to limit the downward movement of the weight 86. The counterweight biases or normally urges the carriage or dolly 66 toward the drill rig in order to retain the dolly 66 in position for engagement with the end of the pipe section 20. The kelly or swivel 80 is adjustably secured in the swivel pipe in the same manner as pipe 44 in FIG. 4.

A tripod 90 removably anchored to the catwalk 14 is provided with a series of vertically spaced holes 92 for receiving a bolt 93 or a pin extending through a hole in the end of a pipe 94 so that the vertical elevation of the pipe 94 may be changed to support the pipe sections as the height of the stack of pipes on the pipe rack varies. By using a plurality of the pipes 94 as illustrated in FIG. 1, the pipe sections 20 may be more easily moved into overlying relation to the catwalk with the vertical adjustment of one end of the pipes 94 and the other free end resting on the pipe sections on the pipe rack enabling the supporting pipes 94 to be substantially horizontally oriented thereby facilitating movement of the pipe sections 20 onto the catwalk from the pipe rack and onto the pipe rack from the catwalk. The structure of the tripod 90 and the vertically spaced pairs of apertures 92 and the end of the supporting pipe 94 supported thereby may be varied to provide a rigid but yet easily adjusted support structure for the pipe sections.

With this construction, the dolly or carriage 64 may be moved longitudinally on the supporting cables 34 by selectively winding and unwinding the cables 36 and 38. The step member 88 on the counterbalance cable 78 will assure that the dolly or carriage 66 will be oriented in proper relationship to the pipe section 20 on the catwalk although the dolly 66 can move toward the rig floor when desired for conveying a pipe section towards the rig floor when the dolly 64 is moved toward the rig floor. The two dollies 66 and 64 can be lowered when the cable 34 is loosened along with the cables 36 and 38 so that the dolly 64 and the dolly 66 are oriented adjacent the catwalk for engagement with a pipe section or for depositing a pipe section on the catwalk. Assuming that the pipe section 20 is to be lifted from the catwalk as illustrated to FIG. 2 to the position illustrated in FIG. 1, it is only necessary to wind in cable 34 while maintaining the cable 38 tight and when the cable 34 has been tightened so that it assumes a straight line condition as illustrated in FIG. 1, the pipe section may then be moved toward the rig floor by winding cable 38 while unwinding cable 36. After the pipe section 20 is picked up by the elevator structure in the drill rig, the dolly 64 is pulled back towards the winch drum assembly and due to the inclined orientation of the supporting cable 34, the dolly 66 will move down the cable 34 to be properly aligned with the end of the next pipe section as the cable 34 is slackened to lower the dollies 64 and 66. The disassembly of the apparatus is expedited inasmuch as the entire supporting post or pipe 50 may be removed by loosening the setscrews 52 thus eliminating the necessity of removing the cables from the pulleys or sheaves and the height of the upper ends of the cables may be varied by telescoping the pipe 44 in relation to the rathole pipe 24 by using the setscrews 48. The winch drums may be powered in any suitable manner such as by hydraulic motors and provided with brakes and control devices for accurately controlling the movement of the cables to assure dependable engagement between the dolly structure and the pipe sections in both directions of movement that is when the dollies are used to pick up a pipe and convey it to the rig or to convey a pipe section from the rig to the catwalk.

Figures 2, 3, 6:
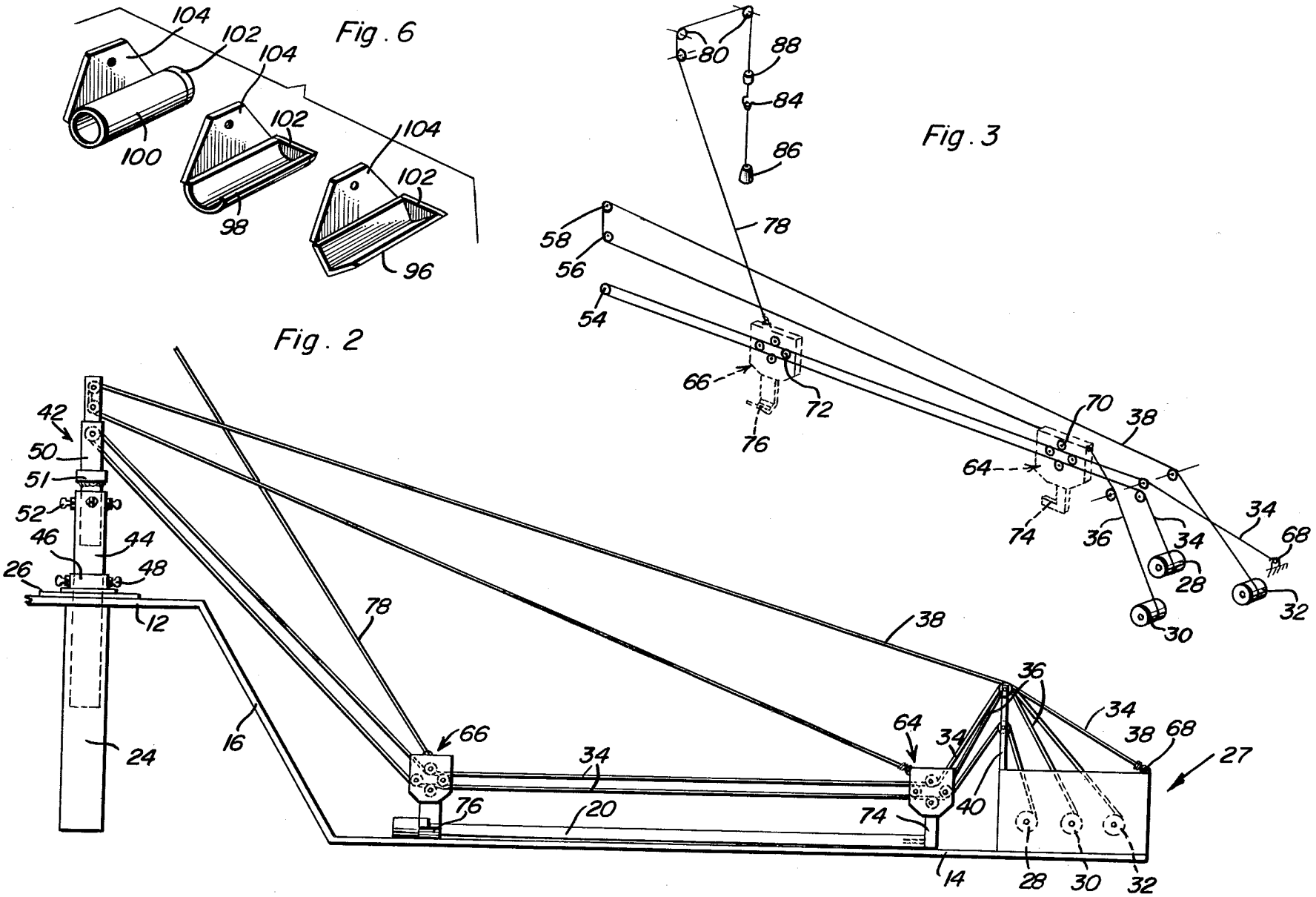
FIG. 2 is a side elevational view of the machine illustrating its relationship to the catwalk when a pipe section is oriented on the catwalk.
FIG. 3 is a schematic view of the cable arrangement.
FIG. 6 is a group perspective view illustrating alternative structures connectible to the dollies for engagement with pipe or casing sections of different sizes.

In FIG. 6, there is shown three alternatives to the hooks 76 including a V-shaped hook 96, which enables many sizes of pipes to be supported, a semi-cylindrical hook 98 and a cylindrical hook 100 for telescopic engagement with a pipe. Each of these forms of the invention has a transverse plate 102 at one end thereof and are supported from dollies 64 and 66 by a plate 104. Tong dies may be welded to the interior of the V-shaped hook 96 to prevent slippage of the pipe. The hook 96 is used on the dolly 66 while hooks 98 and 100 are interchangeably used with dolly 64.

In order to lay down a pipe joint 20, the rig crew breaks out a joint of pipe and the lower end is placed in the hook or bucket 74 on dolly 64 which is pulled back toward the catwalk 14 from its position adjacent the rig. At the same time, the driller lowers the end of the pipe joint or section down until it is laying generally horizontal and about even with the hook 76 on dolly 66. The elevators are released from the pipe joint when it is supported by the hooks 74 and 76. The dollies 64 and 66 are pulled toward the catwalk until the pipe joint 20 overlies the support pipes 94. The cable 34 then is slacked thus lowering the pipe joint 20 onto support pipes 94. The hook 76 disengages from the pipe joint 20 and the hook 74 is disengaged by pulling dolly 64 away from the end of the pipe joint 20. The pipe joint 20 is then rolled onto the rack.

In order to pick up a section of pipe or casing, dolly 66 is set with the counterbalance 80 and clamp 52 so that dolly 66 is about 3 feet from the end of the pipe joint or section. Cable 34 is then tightened and the dollies 64 and 66 are moved to the rig floor. A pick up line engaged with the traveling block is engaged with the pipe section or joint and the traveling block is moved upwardly thus elevating the pipe section or joint up into the rig with dolly 64 being moved back toward the catwalk to disconnect it from the pipe section. To pick up small pipe, the same procedure is used with the elevators being engaged on the small pipe and lifted up in the derrick by the traveling block and the hook 74 is removed from the pipe section 20 as it reaches a generally vertical position.

The counterbalance cable 78 and related structure may be omitted by providing a cable clamp on cable 34 to limit movement of block 66 inwardly. In this arrangement, cables 34 do not pass through the block 64 and the position of block 66 is determined by the position of the cable clamp.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A pipe laydown and pickup apparatus for use in combination with an on-site well rig including a derrick provided with a rig floor having a rathole pipe associated therewith and a catwalk extending outwardly from the derrick alongside a pipe rack comprising a draw works oriented at the outer end of the catwalk with a cable assembly connected therewith, a support means for the cable assembly inserted into the rathole pipe, said cable assembly supporting a pair of pipe sections supporting dollies for movement thereon and for vertical movement when the cable assembly is slackened or tightened in order to pick up a pipe section from the catwalk and convey it toward the drill rig floor or convey a pipe section from the drill rig to the catwalk, said cable assembly including a supporting cable having one end anchored to the draw works and the other end wound on a winch drum on the draw works with an intermediate portion supported by a pulley on the cable assembly support means in the rathole pipe with the two runs of the cable being vertically spaced, each of the dollies including a plurality of pulleys thereon engaged both runs of the cables for maintaining the dollies in a stable, vertical orientation, said cable assembly also including a cable attached to the dolly remote from the drill rig and wound on a winch drum on the draw works for moving the remote dolly toward and away from the drill rig, said cable assembly support means including a support member telescopically adjustable in the rathole pipe with means locking the support member in vertically adjusted positions to vary the elevational position of the cable assembly in relation to the drill rig floor.

2. The structure as defined in claim 1 wherein said support member includes a detachable sheave assembly to enable disassembly of the cable assembly without pulling the cables through the sheaves.

3. The structure as defined in claim 1, together with a counterbalance cable and weight connected with the dolly adjacent the drill rig for returning the dolly to predetermined relation to the catwalk and pipe section thereon.

4. The structure as defined in claim 1, wherein said catwalk includes a pair of upstanding support members thereon, each support member including a laterally extending pipe section supporting element thereon having a free end portion engaging the pipe rack or pipe sections thereon, and means vertically adjustably connecting the other end portion of the pipe section supporting element to the support member for retaining the pipe section supporting elements in generally horizontal position.

5. A pipe laydown and pickup apparatus for use in combination with an on-site well rig including a derrick provided with a rig floor having a rathole pipe associated therewith and a catwalk extending outwardly from the derrick alongside a pipe rack comprising a draw works oriented at the outer end of the catwalk with a cable assembly connected therewith, a support means for the cable assembly inserted into the rathole pipe, said cable assembly supporting a pair of pipe sections supporting dollies for movement thereon and for vertical movement when the cable assembly is slackened or tightened in order to pick up a pipe section from the catwalk and convey it toward the drill rig floor or convey a pipe section from the drill rig to the catwalk, said cable assembly including a supporting cable having one end anchored to the draw works and the other end wound on a winch drum on the draw works with an intermediate portion supported by a pulley on the cable assembly support means in the rathole pipe with the two runs of the cable being vertically spaced, each of the dollies including a plurality of pulleys thereon engaging both runs of the cables for maintaining the dollies in a stable, vertical orientation, said cable assembly also including a cable attached to the dolly remote from the drill rig and wound on a winch drum on the draw works for moving the remote dolly toward and away from the drill rig, and a counterbalance cable and weight connected with the dolly adjacent the drill rig for returning the dolly to predetermined relation to the catwalk and pipe section thereon.

* * * * *